US009692156B2

(12) United States Patent
Matsumoto et al.

(10) Patent No.: US 9,692,156 B2
(45) Date of Patent: Jun. 27, 2017

(54) ELECTRONIC DEVICE

(71) Applicant: DENSO CORPORATION, Kariya, Aichi-pref. (JP)

(72) Inventors: Eiichi Matsumoto, Kariya (JP); Yoshio Hironaka, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/200,017

(22) Filed: Jul. 1, 2016

(65) Prior Publication Data

US 2017/0077627 A1 Mar. 16, 2017

(30) Foreign Application Priority Data

Sep. 14, 2015 (JP) ..... 2015-180938

(51) Int. Cl.
*H01R 12/00* (2006.01)
*H01R 12/58* (2011.01)
*H01R 13/03* (2006.01)

(52) U.S. Cl.
CPC ..... *H01R 12/585* (2013.01); *H01R 13/03* (2013.01)

(58) Field of Classification Search
CPC .. H01R 12/585; H01R 12/7029; H01R 13/03; H01R 13/111; H01C 10/34
USPC ..... 439/84
See application file for complete search history.

(56) References Cited

U.S. PATENT DOCUMENTS 6,572,404 B1 * 6/2003 Wu ..... H01R 12/7029 439/567
7,344,389 B2 * 3/2008 Kramski ..... H01R 12/585 439/82
9,166,310 B2 * 10/2015 Ludwig ..... H01R 12/585
2006/0246786 A1 * 11/2006 Noguchi ..... H01R 12/585 439/751
2007/0149015 A1 * 6/2007 Minoura ..... H01R 13/111 439/157
2008/0211618 A1 * 9/2008 Araki ..... H01C 10/34 338/166
2009/0183911 A1 * 7/2009 Sunohara ..... H05K 3/4092 174/267

FOREIGN PATENT DOCUMENTS

JP 2004-134301 A 4/2004

* cited by examiner

*Primary Examiner* — Jean F Duverne

(57) ABSTRACT

An electronic device includes a substrate, and a press-fit terminal. The substrate includes a first surface, a second surface opposite to the first surface in a thickness direction of the substrate, a through hole, and an electrode formed in the first surface, the second surface, and a wall of the through hole. The press-fit terminal is fit into the through hole from the first surface while being elastically deformed. The press-fit terminal is connected to the electrode by a reaction force due to the elastic deformation of the press-fit terminal. The substrate includes (i) a core layer that is overlapped, in the thickness direction, with a contact portion of the electrode with the press-fit terminal, and (ii) a flexible layer that is at a position closer to the first surface than the core layer is to. The flexible layer has a lower elastic modulus than the core layer.

8 Claims, 6 Drawing Sheets

ELECTRONIC DEVICE

CROSS REFERENCE TO RELATED APPLICATION

This application is based on reference Japanese Patent Application No. 2015-180938 filed on Sep. 14, 2015, the disclosure of which is incorporated herein by reference.

TECHNICAL FIELD

The present disclosure relates to an electronic device including a substrate having a through hole and a press-fit terminal fit into the through hole.

BACKGROUND

Conventionally, there has been known an electronic control unit (electronic device) that includes a circuit board (substrate) and a press-fit terminal (see, for example, Patent Literature 1: JP 2004-134301 A). The circuit board includes a through hole into which the press-fit terminal is fit and a conductor (land) formed in a wall of the through hole.

In Patent Literature 1, the press-fit terminal is fit into the through hole via a jig for press fitting. After inserting a hollow jig into the through hole, the press-fit terminal is fit into the jig. Next, the jig is removed from the through hole, and then the press-fit terminal is fit into the through hole. Compared with a way of press-fitting without the jig, it is possible to suppress an increase in load applied to the circuit board generated when press-fitting the press-fit terminal. Therefore, damage to the circuit board due to the press-fitting of the press-fit terminal can be suppressed.

However, in the above-described way, the width of the press-fit terminal along a direction perpendicular to the thickness direction of the circuit board needs to be narrower than the internal diameter of the jig. In other words, greater deformation of the press-fit terminal is needed as compared with a way without using the jig. Thus, there is concern about plastic deformation of the press-fit terminal. When the plastic deformation of the press-fit terminal occurs after pulling out the jig, a contact reaction force applied to the substrate from the press-fit terminal may decrease. As a result, after pulling out the jig, a holding force acting between the press-fit terminal and the circuit board may be decreased.

In view of the above, it is an objective of the present disclosure to provide an electronic device that suppresses an increase in load applied to a substrate when press-fitting the press-fit terminal and that maintains a holding force between the substrate and the press-fit terminal.

SUMMARY

In an aspect of the present disclosure, an electronic device includes a substrate, and a press-fit terminal. The substrate includes a first surface, a second surface opposite to the first surface in a thickness direction of the substrate, a through hole, and an electrode formed in the first surface, the second surface, and a wall of the through hole. The press-fit terminal is fit into the through hole from the first surface while being elastically deformed. The press-fit terminal is connected to the electrode by a reaction force due to the elastic deformation of the press-fit terminal. The substrate includes (i) a core layer that is overlapped, in the thickness direction, with a contact portion of the electrode with the press-fit terminal, and (ii) a flexible layer that is at a position closer to the first surface than the core layer is to. The flexible layer has a lower elastic modulus than the core layer.

In the aspect, when press-fitting the press-fit terminal into the through hole, the flexible layer can be easily deformed by load from the press-fit terminal. Thus, an increase in load applied to the substrate during the press-fitting of the press-fit terminal can be suppressed by the deformation of the flexible layer.

The direction in which load is applied to the substrate from the press-fit terminal is perpendicular to the thickness direction of the substrate. In the above-described configuration, the core layer that is less deformable than the flexible layer is overlapped, in the thickness direction, with the contact portion of the electrode with the press-fit terminal. Accordingly, after press-fitting the press-fit terminal into the through hole, the substrate can be less likely to be deformed due to load from the press-fit terminal. Hence, it is possible to suppress a decrease in a holding force between the press-fit terminal and the substrate.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION

As follows, a plurality of embodiments of the present disclosure will be described in detail. It is needless to say that the embodiments are some examples of the present disclosure, and therefore the present disclosure is not limited to these embodiment. Furthermore, each of the substantially same structures among the embodiments will be assigned to the respective common referential numeral and the description of the substantially same structures will be omitted in the subsequent embodiments. In the following, a thickness direction of a substrate is defined as a direction Z, a particular direction perpendicular to the direction Z is defined as a direction X, and a direction perpendicular to both the direction Z and the direction X is defined as a direction Y. Furthermore, a plane defined by the direction X and the direction Y is defined as an X-Y plane and a shape along the X-Y plane is referred as a "plane shape".

First Embodiment

Figure 1:
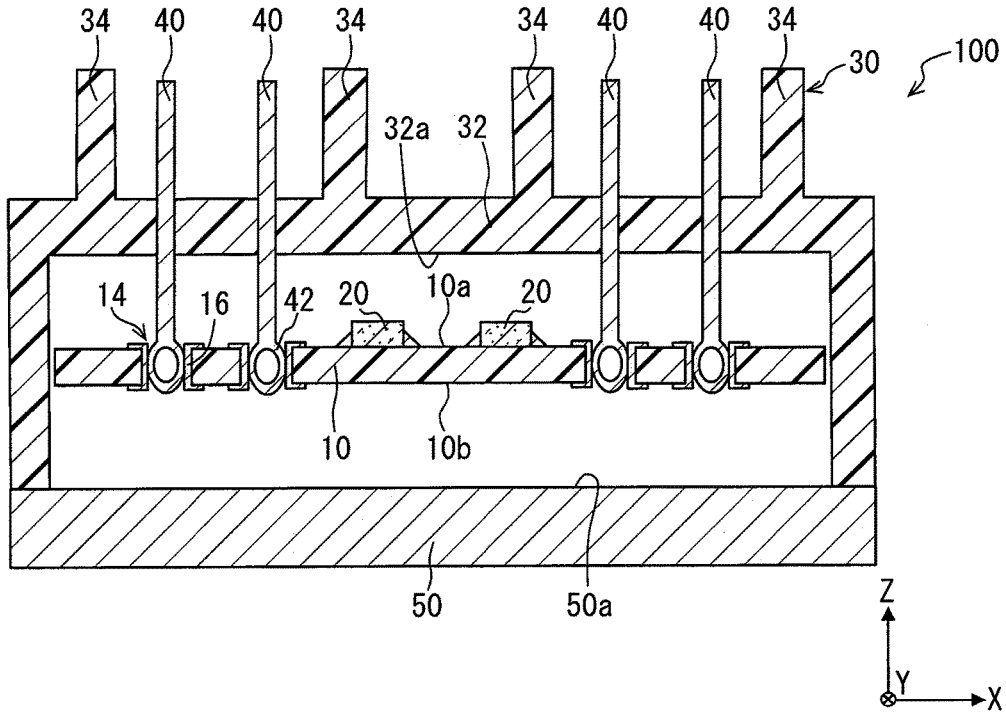
FIG. 1 is a cross-sectional view schematically illustrating an electronic device according to a first embodiment.
Figure 2:
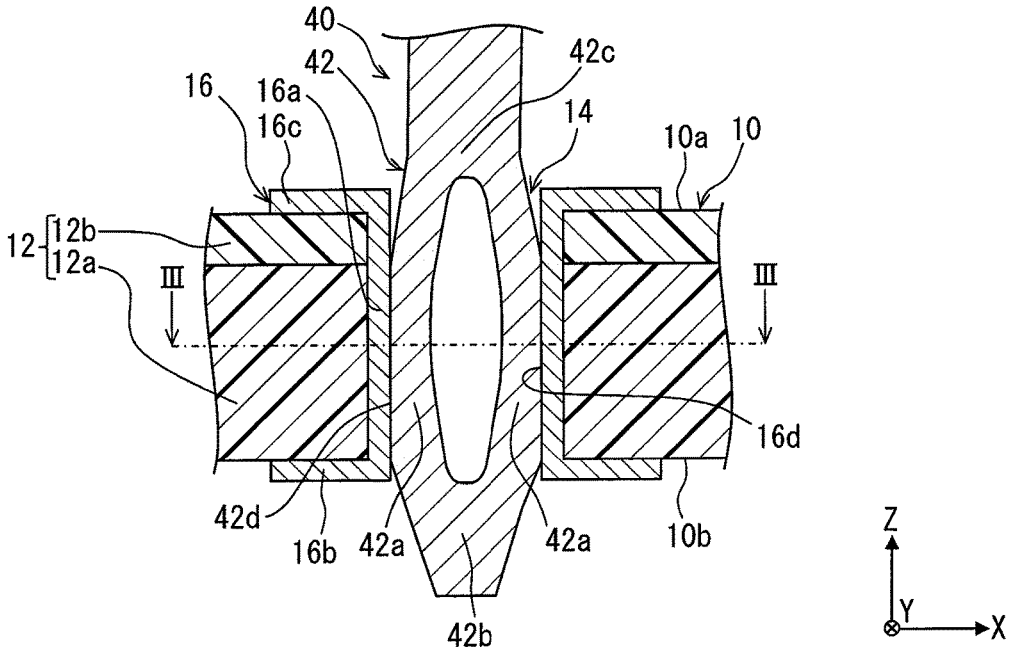
FIG. 2 is a cross-sectional view illustrating a substrate and a press-fit terminal.
Figure 3:
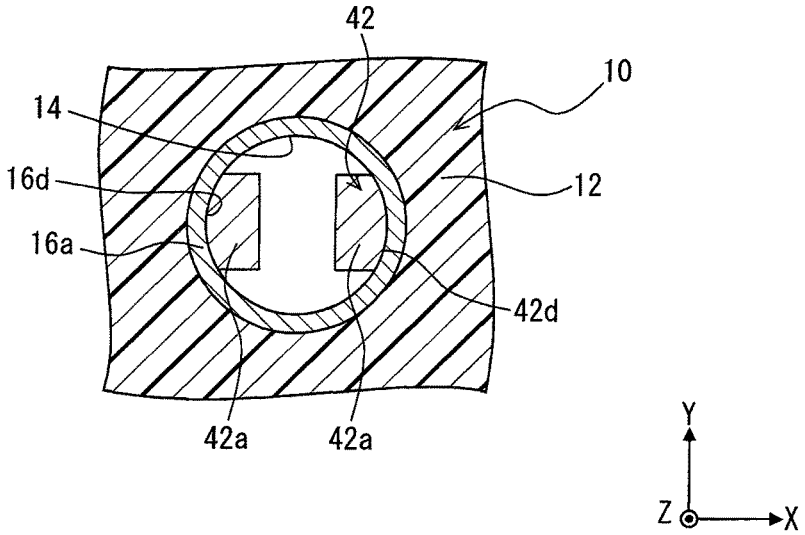
FIG. 3 is a cross-sectional view taken along III-III line in FIG. 2.

Referring to FIGS. 1 to 3, a schematic configuration of an electronic device 100 will be described.

As shown in FIG. 1, the electronic device 100 includes a substrate 10, electronic components 20, a case 30, press-fit terminals 40, and a housing 50. In the present embodiment, the electronic device 100 is an electronic control unit (ECU) for a vehicle. The electronic device 100 is connected to a battery and an ECU, which is different from the electronic device 100 and is mounted on the vehicle.

As shown in FIG. 2, the substrate 10 includes a base 12, through holes 14, and electrodes 16. The substrate 10 includes a top surface (first surface) 10*a* and a bottom surface (second surface) 10*b* that is opposite to the top surface 10*a*. In the present embodiment, the top surface 10*a* and the bottom surface 10*b* are formed as planes perpendicular to the direction Z. The substrate 10 is a printed circuit board.

The base 12 serves as an electric insulation layer of the substrate 10. The base 12 includes a core layer 12*a*, a flexible layer 12*b* more flexible than the core layer 12*a*. The core layer 12*a* and the flexible layer 12*b* are laminated on each other in the direction Z. More specifically, the flexible layer 12*b* is formed at a position closer to the top surface 10*a* than the core layer 12*a* is to. One surface of the flexible layer 12*b* serves as the top surface 10*a* of the substrate 12.

A resin material having peel strength of 0.9 N/mm or more and having an elastic modulus more than 10 GPa can be used as material of the core layer 12*a*. In the present embodiment, the core layer 12*a* has an elastic modulus of 16 GPa. On the contrary, a resin material having peel strength of 0.9 N/mm or less and having elastic modulus of 10 GPa or less can be used as material of the flexible layer 12*b*. In the present embodiment, the flexible layer 12*b* has an elastic modulus of 8 GPa. In the present embodiment, the core layer 12*a* and the flexible layer 12*b* are formed with a pre-preg formed by infiltrating resin into a glass cloth. A type of resin to be infiltrated into the glass cloth used for the core layer 12*a* is different from that for the flexible layer 12*b*.

The through hole 14 is a hole of the substrate 10 at which the substrate 10 is mechanically connected to the press-fit terminal 40. The through hole 14 passes through the substrate 10 from the top surface 10*a* to the bottom surface 10*b*. As shown in FIG. 3, an opening surface of the through hole 14 has a substantially circular shape.

The electrode 16 is an electrode for the substrate 10 that is disposed at the through hole 14. The electrode 16 is formed of metallic material, more specifically, of nickel. In other words, the electrode 16 includes a plating layer formed of nickel. In the present embodiment, the electrode 16 further includes another plating layer formed of copper and gold in addition to the plating layer formed of nickel. The electrode 16 is formed by laminating a plurality of the plating layers on each other.

The electrode 16 includes a wall portion 16*a* formed on a wall of the through hole 14, a bottom portion 16*b* formed on the bottom surface 10*b*, and a top portion 16*c* formed on the top surface 10*a*. The wall portion 16*a* defines a wall surface of the through hole 14. The wall portion 16*a*, the bottom portion 16*b*, and the top portion 16*c* are connected to each other.

The wall portion 16*a*, the bottom portion 16*b*, and the top portion 16*c* exhibit a substantially annular plane shape having an inner circumferential edge and an outer circumferential edge. When viewed in the direction Z, the inner circumferential edges of the wall portion 16*a*, the bottom portion 16*b*, and the top portion 16*c* are overlapped with each other. Furthermore, when viewed in the direction Z, the outer circumferential edges of the bottom portion 16*b* and the top portion 16*c* surround the outer circumferential edge of the wall portion 16*a*.

In the present embodiment, the substrate 10 further includes two pairs of a circuit layer, a land, and a solder resist, all of which are not illustrated. One of the two pairs of the circuit layer, the land, and the solder resist is formed on one side of the core layer 12*a* opposite to the flexible layer 12*b* and the other of the two pairs is formed on one side of the flexible layer 12*b* opposite to the core layer 12*a*. A circuit layer is further formed between the core layer 12*a* and the flexible layer 12*b*. The land is an electrode of the substrate 10 for mounting the electronic component 20 on the substrate 10.

The substrate 10 is fixed to at least one of the case 30 and the housing 50. For example, fastening by a screw may be used as means for fixing the substrate 10. Alternatively, a press-fit terminal (not illustrated) different from the press-fit terminal 40, which is fixed to the case 30, may be used to fix the substrate 10 to the case 30. In this case, the press-fit terminal different from the press-fit terminal 40 may be fit into a through hole in the substrate 10 that is different from the through hole 14.

The electro components 20 form an electronic circuit together with the substrate 10. In the present embodiment, the electro components 20 are a surface mounted type component. However, a mounting structure for the electronic components 20 may be not limited to the present embodiment. The insertion mounted type can be used in addition to the surface mounted type. A diode, a coil, a capacitor, a resistor, an IC chip, a microcomputer, an ASIC, or the like may be used as the electronic component 20.

The case 30 serves as a housing member that houses a portion of the press-fit terminal 40, the substrate 10, and the electronic component 20, and as a connector for the electronic device 100. The case 30 includes a bottom 32 and has a box shape with an opening at one side of the case 30 opposite to the bottom 32. The bottom 32 has a substantially plate shape having a thickness along the direction Z. The opening of the case 30 is closed by the housing 50. The case 30 is arranged to cover the substrate 10 and the electronic components 20. An internal surface 32*a* of the bottom 32 close to the substrate 10 faces the top surface 10*a* in the direction Z. The case 30 is formed of resin material.

The case 30 further includes extension portions 34 that extend from the bottom 32 in the direction Z away from the substrate 10. Each of the extension portions 34 has a substantially cylindrical shape. The extension portions 34 and the bottom 32 provide a connector housing into which a connector for external components is fit. In the present embodiment, the external components are the battery and the ECU.

The press-fit terminals 40 are integrally formed with the bottom 32 by insert molding. In other words, the press-fit terminals 40 are held by the bottom 32. The connector housing and the press-fit terminals 40 provide a connector for the electronic device 100. Each of the press-fit terminals 40 and the external components are electrically connected to each other when the connector of the external components is fit into the connector housing.

The press-fit terminal 40 extends in the direction Z. One ends of the press-fit terminals 40 exist inside a space defined between the extension portions 34. The other ends of the press-fit terminals 40 form elastic members 42 fit into the through holes 14. The elastic member 42 is fit into the through hole 14 from the top surface 10*a* of the substrate 10. The elastic member 42 press-fit into the through hole 14 applies a reaction force generated from elastic deformation to the wall portion 16*a*. As a result, the press-fit terminal 40 and the substrate 10 are held by each other, and therefore electrically and mechanically connected to each other.

The elastic member 42 includes a pair of arms 42*a*, a first connector 42*b*, and a second connector 42*c*. The pair of arms 42*a* face each other in the direction X and each of the arms 42*a* includes a contact surface 42*d* in contact with the wall portion 16*a*. In other words, the electrode 16 includes a contact portion 16*d* in contact with the press-fit terminal 40. The contact surface 42*d* is defined as a portion of the arm 42*a* that is in contact with the electrode 16. The contact surface 42*d* extends along the direction Z and has a curved surface along the wall surface of the through hole 14.

The contact portion 16*d* is a portion of the wall portion 16*a* that is in contact with the arm 42*a*. That is, the contact portion 16*d* is a portion of the substrate 10 that is in contact with the press-fit terminal 40. The contract portion 16*d* is within a specified region along the direction Z. The contact portion 16*d* is formed to be overlapped, in the direction Z, with the core layer 12*a*. In other words, the substrate 10 and the press-fit terminal 40 are arranged so that the contact portion 16*d* is overlapped with the core layer 12*a* in the direction Z. In the present embodiment, the entire region of the contact portion 16*d* is overlapped with the substantially entire region of the core layer 12*a* along the direction Z. Accordingly, the contact portion 16*d* is not overlapped with the flexible layer 12*b* in the direction Z.

The first connector 42*b* connects one ends of the arms 42*a*. The first connector 42*b* also serves as a tip end of the press-fit terminal 40. The second connector 42*c* connects the other ends of the arms 42*a*.

The housing 50 serves, together with the case 30, as a housing member that houses a portion of each of the press-fit terminals 40, the substrate 10, and the electronic components 20. In other words, the housing 50 defines, together with the case 30, a housing space that houses the portions of the press-fit terminals 40, the substrate 10, and the electronic components 20.

The housing 50 has a substantially plate shape having a thickness along the direction Z. An inner surface 50*a* of the housing 50 close to the substrate 10 faces the substrate 10 in the direction Z. The inner surface 50*a* closes the opening of the case 30. The housing 50 is formed of, e.g., metallic material or resin material.

Figure 4:
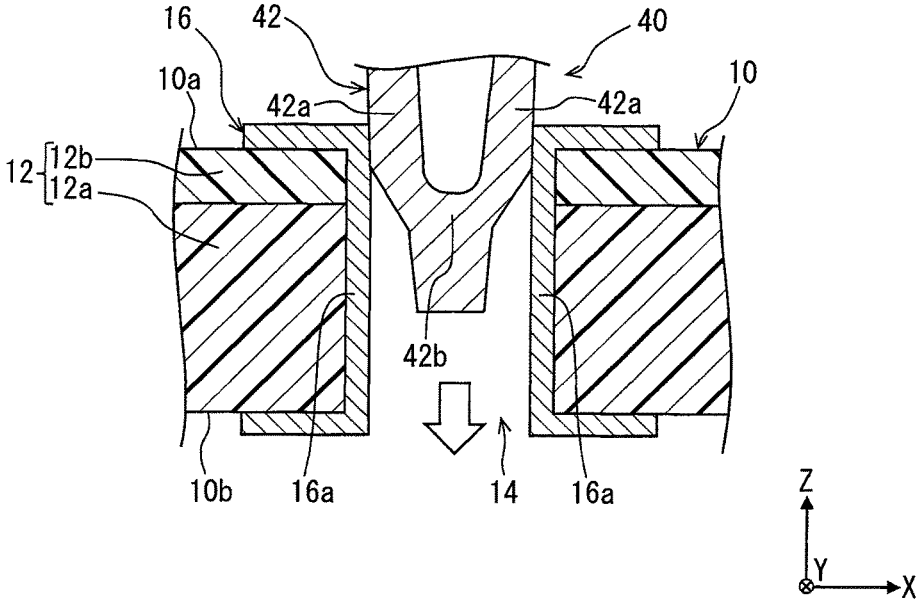
FIG. 4 is a cross-sectional view for explaining a press-fitting process.

Next, a method for assembling the electronic device 100 will be described with reference to FIGS. 4 and 5.

Initially, the substrate 10, on which the electronic components 20 are mounted, and the case 30, that is integrally formed with the press-fit terminals 40, are prepared. Then, as shown in FIG. 4, each of the press-fit terminals 40 is fit into the respective through hole 14. Hereinafter, a process of press-fitting the press-fit terminal 40 into the through hole 14 is referred to as a press-fitting process. The elastic member 42 is fit into the through hole 14 by moving the case 30 and the press-fit terminal 40 toward the substrate 10 along the direction Z. Hereinafter, the direction, which is along the direction Z and in which the case 30 and the press-fit terminal 40 are moved toward the substrate 10, is referred to as a press-fitting direction. The press-fitting direction is a direction from the top surface 10*a* toward the bottom surface 10*b* along the direction Z. The arrow in FIG. 4 indicates the press-fitting direction.

Figure 5:
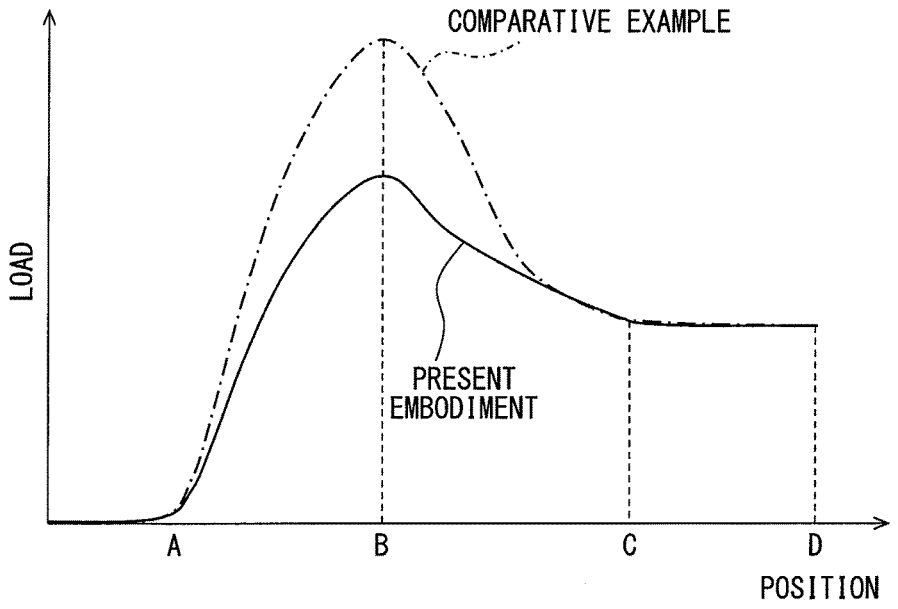
FIG. 5 is a diagram showing load applied to the substrate in the press-fitting process.

FIG. 5 shows a change of strength of load applied to the substrate 10 from the press-fit terminal 40 with respect to positions of the press-fit terminal 40 along the press-fitting direction. The position of the press-fit terminal 40 along the press-fitting direction is a insertion depth of the press-fit terminal 40 relative to the through hole 14. FIG. 5 also shows a comparative example where the press-fitting process is performed with a comparative substrate that does not have the flexible layer 12*b*. The one-dot line indicates a change of strength of load applied to the comparative substrate in the comparative example.

When moving the press-fit terminal 40 toward the substrate 10 in the press-fitting direction during the press-fitting process, the press-fit terminal 40 is brought into contact with the electrode 16 at a position A. When further moving the press-fit terminal 40 in the press-fitting direction from the position A, the press-fit terminal 40 reaches at a position B. The load applied to the substrate 10 increases as the press-fit terminal 40 is moved from the position A toward the position B.

In the press-fitting process, the load applied to the substrate 10 has a maximum value when the press-fit terminal 40 is at the position B. Therefore, in the comparative substrate, breakage of the press-fit terminal 40 likely occurs when the press-fit terminal 40 is at the position B. For example, separation of at least a portion of the land formed in the wall of the through hole or separation between the layers in the substrate 10 may occur as the breakage of the press-fit terminal 40.

When moving the press-fit terminal 40 from the position B in the press-fitting direction, the press-fit terminal 40 reaches at a position C. The load applied to the substrate 10 decreases as the press-fit terminal 40 is moved from the position B toward the position C.

In the press-fitting process, load is applied to the substrate 10 from the press-fit terminal 40 in a direction perpendicular to the direction Z. In the present embodiment, the flexible layer 12*b* is deformed due to load from the press-fit terminal 40 such that the width of the through hole 14 along the direction X expands. As a result, in the present embodiment, load applied to the substrate 10 is lowered as compared with the comparative example when the press-fit terminal 40 is in the range between the position A and the position C.

When moving the press-fit terminal 40 from the position C in the press-fitting direction, the press-fit terminal 40 reaches at the position D. When the press-terminal 40 reaches at the position D, the press-fitting process is terminated. The position D is defined as a position that the press-fit terminal 40 and the substrate 10 are held with each other. FIG. 2 shows the press-fit terminal 40 at the position D. The load applied to the substrate 10 is substantially constant during the movement of the press-fit terminal 40 from the position C toward the position D.

When the press-fit terminal 40 is at a position between the position C and the position D, at least a portion of the contact portion 16*d* is overlapped with the core layer 12*a* in the direction Z. As a result, the substrate 10 with the press-fit terminal 40 at a position between the position C and the position D is less likely deformed as compared with the substrate 10 with the press-fit terminal 40 at a position between the position A and the position C. Accordingly, load applied to the substrate 10 has the substantially same as the value of the comparative example when the press-fit terminal 40 is at a position between the position C and the position D.

In the press-fitting process, a portion of the wall portion 16*a* is worn due to the press-fitting of the press-fit terminal 40. As a result, an oxide film formed on the surface of the wall portion 16*a* can be removed. By the removal of the oxide film, reliability of electric connection between the substrate 10 and the press-fit terminal 40 can be improved. After the press-fitting process, the housing 50 is fixed to at least one of the case 30 and the substrate 10. Then, assembly of the electronic device 100 is completed.

Next, effects of the electronic device 100 according to the above-described embodiment will be described.

In the present embodiment, when press-fitting the press-fit terminal 40 into the through hole 14, the flexible layer 12*b* is easily deformed due to load from the press-fit terminal 40. As a result, an increase in load applied to the substrate 10 during the press-fitting process can be suppressed due to the deformation of the flexible layer 12*b*.

As described above, the direction of load applied to the substrate 10 from the press-fit terminal 40 is a direction perpendicular to the direction Z. In the present embodiment, the core layer 12*a* that is less likely deformed than the flexible layer 12*b* is arranged to overlap with the contact portion 16*d* in the direction Z. Thus, the substrate 10 is less likely deformed due to load from the press-fit terminal 40 after the press-fit terminal 40 is fit into the through hole 14. Accordingly, a decrease in a holding force acting between the press-fit terminal 40 and the substrate 10 can be suppressed. It should be noted that the holding force has the same value of a force necessary to pull the press-fit terminal 40 out of the substrate 10 in a state where the electronic device 100 is assembled.

Generally, a land formed of nickel is more breakable and fragile than a land formed of gold or copper. Therefore, it would be difficult to use the land formed of nickel at the wall of the through hole 14 in a conventional substrate.

On the contrary, in the present embodiment, an increase in load applied to the substrate 10 during the press-fitting of the press-fit terminal 40 can be suppressed because of the flexible layer 12*b*. Therefore, even if the electrode 16 is formed of nickel, breakage of the electrode 16 can be suppressed. Hence, nickel can be used as a material for the electrode 16, and therefore options of material for the electrode 16 can be increased.

Second Embodiment

Next, a second embodiment will be described with reference to FIGS. 6 and 7.

Figure 6:
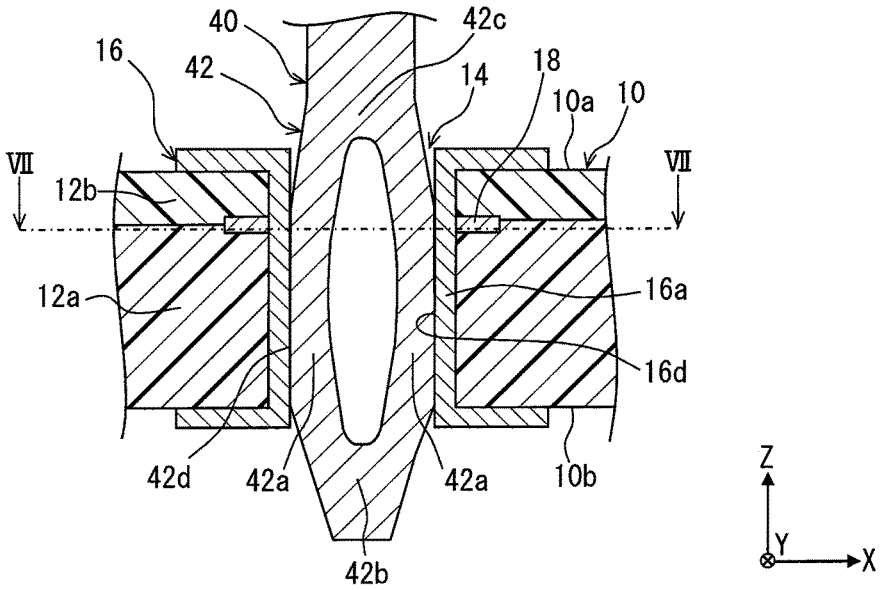
FIG. 6 is a cross-sectional view illustrating the substrate and the press-fit terminal in the electronic device according to a second embodiment.
Figure 7:
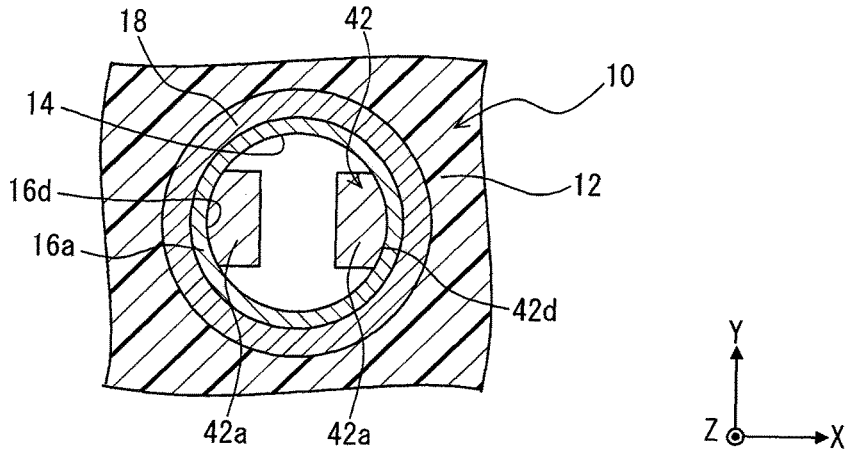
FIG. 7 is a cross-sectional view taken along III-III line in FIG. 6.

As shown in FIGS. 6 and 7, the substrate 10 further includes an intermediate conductor 18. The intermediate conductor 18 has rigidity greater than the core layer 12*a* and flexible layer 12*b*. The intermediate conductor 18 is formed of metallic material.

The intermediate conductor 18 partially exists between the core layer 12*a* and the flexible layer 12*b*. In other words, when viewed in the direction Z, only portions of the core layer 12*a* and the flexible layer 12*b* are overlapped with the entire of the intermediate conductor 18. The intermediate conductor 18 is overlapped with the contact portion 16*d* in the direction Z. More specifically, the intermediate conductor 18 is overlapped in the direction Z with a portion of the contact portion 16*d* that is close to the top surface 10*a*. The intermediate conductor 18 is arranged to surround the wall portion 16*a*.

In the present embodiment, the intermediate conductor 18 is connected to the wall portion 16*a* of the electrode 16. That is, the intermediate conductor 18 is connected to the electrode 16. In other words, the intermediate conductor 18 is electrically and mechanically connected to the electrode 16. In the present embodiment, the intermediate conductor 18 does not provide electric connection, and therefore is not connected to the circuit layer of the substrate 10.

In the present embodiment, the intermediate conductor 18 has a plane shape around the wall portion 16*a*. The intermediate conductor 18 has a substantially ring shape having a hole passing therethrough in the direction Z. The plane shape of the intermediate conductor 18 has a substantially annular shape having an inner circumferential edge and an outer circumferential edge. When viewed in the direction Z, the inner circumferential edge of the intermediate conductor 18 is overlapped with the outer circumferential edge of the wall portion 16*a*.

In the present embodiment, deformation of the substrate 10 after press-fitting the press-fit terminal 40 can be effectively suppressed by the intermediate conductor 18. Thus, a decrease in a holding force acting between the press-fit terminal 40 and the substrate 10 can be effectively suppressed.

In the present embodiment, the intermediate conductor 18 is connected to the electrode 16. Accordingly, deformation of the substrate 10 is further effectively suppressed as compared to a case where the intermediate conductor 18 is arranged away from the electrode 16. Therefore, a decrease in the holding force can be effectively suppressed.

In the present embodiment, the plane shape of the intermediate conductor 18 is the annular shape around the through hole 14. Thus, deformation of the substrate 10 in all directions perpendicular to the direction Z can be suppressed. Therefore, a decrease in the holding force can be effectively suppressed.

Figure 8:
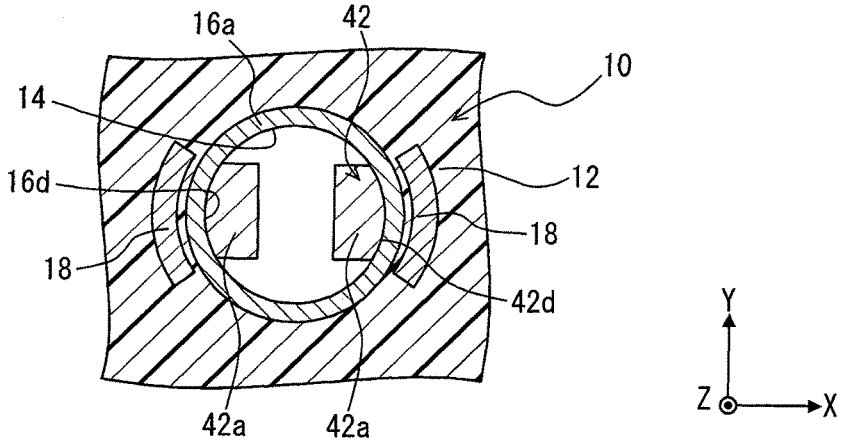
FIG. 8 is a cross-sectional view illustrating the substrate and the press-fit terminal in the electronic device according to a modification, which corresponds to FIG. 7.

Although, the intermediate conductor 18 is connected to the electrode 16 in the present embodiment, it would not be limited to this configuration. For example, as shown in a first modification illustrated in FIG. 8, the intermediate conductors 18 may be arranged to be away from the electrode 16. In this example, the intermediate conductors 18 are not electrically and mechanically connected to the electrode 16 and the circuit layer.

In the first modification, the substrate 10 includes two intermediate conductors 18. The intermediate conductors 18 are arranged at both sides of the wall portion 16*a* in the direction X. As a result, the two arms 42*a* are interposed between the two intermediate conductors 18 in the direction X. The base 12 is disposed between the intermediate conductor 18 and the wall portion 16*a*. Each of the intermediate conductors 18 has a curved plane shape (fan shape). One side surface of each of the intermediate conductors 18 that faces the wall portion 16*a* is a curved surface extending along the wall portion 16*a*.

In the present modification, the intermediate conductors 18 are not connected to the circuit layer of the substrate 10. However, the intermediate conductors 18 may electrically connect between the electrode 16 and the circuit layer. In this example, the intermediate conductors 18 also serve as a circuit layer of the substrate 10. Alternatively, the intermediate conductors 18 may be connected to only the circuit layer and not to the electrode 16.

Third Embodiment

Next, a third embodiment will be described with reference to FIG. 9.

Figure 9:
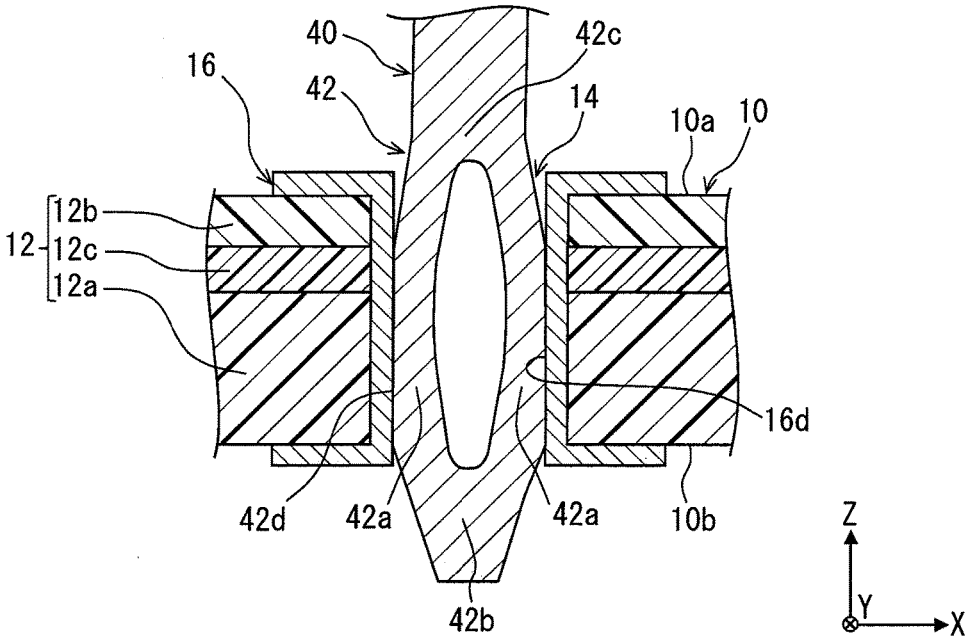
FIG. 9 is a cross-sectional view illustrating the substrate and the press-fit terminal in the electronic device according to a third embodiment.

As shown in FIG. 9, the substrate 10 further includes a center layer 12*c* between the core layer 12*a* and the flexible layer 12*b*. In the substrate 10, the core layer 12*a*, the center layer 12*c*, and the flexible layer 12*b* are laminated on each other in the direction Z. In the present embodiment, the center layer 12*c* is overlapped with the contact portion 16*d* in the direction Z. More specifically, a portion of the contact portion 16*d* that is close to the top surface 10*a* is overlapped with the entire of the center layer 12*c*. Alternatively, the center layer 12*c* may be not overlapped with the contact portion 16*d* in the direction Z.

The center layer 12*c* has an elastic modulus with a value falling within the core layer 12*a* and the flexible layer 12*b*. In the present embodiment, the elastic modulus of the center layer 12*c* is set to be about 12 GPa. In the present embodiment, the center layer 12*c* forms a portion of the base 12. In other words, the center layer 12*c* is an electric insulation layer of the substrate 10. As with the core layer 12*a* and the flexible layer 12*b*, the center layer 12*c* is formed with a pre-preg formed by infiltrating resin into a glass cloth. A type of resin to be infiltrated into the glass cloth for the center layer 12*c* is different from the core layer 12*a* and the flexible layer 12*b*.

In the present embodiment, the center layer 12*c* is more deformable than the core layer 12*a* but less deformable than the flexible layer 12*b*. Therefore, deformation of the center layer 12*c* due to load from the press-fit terminal 40 can be less than that of the flexible layer 12*b* and more than that of the core layer 12*a*. As a result, separation between the layers in the substrate 10 can be suppressed by the center layer 12*c*.

Fourth Embodiment

Next, a fourth embodiment will described with reference to FIGS. 10 and 11.

Figure 10:
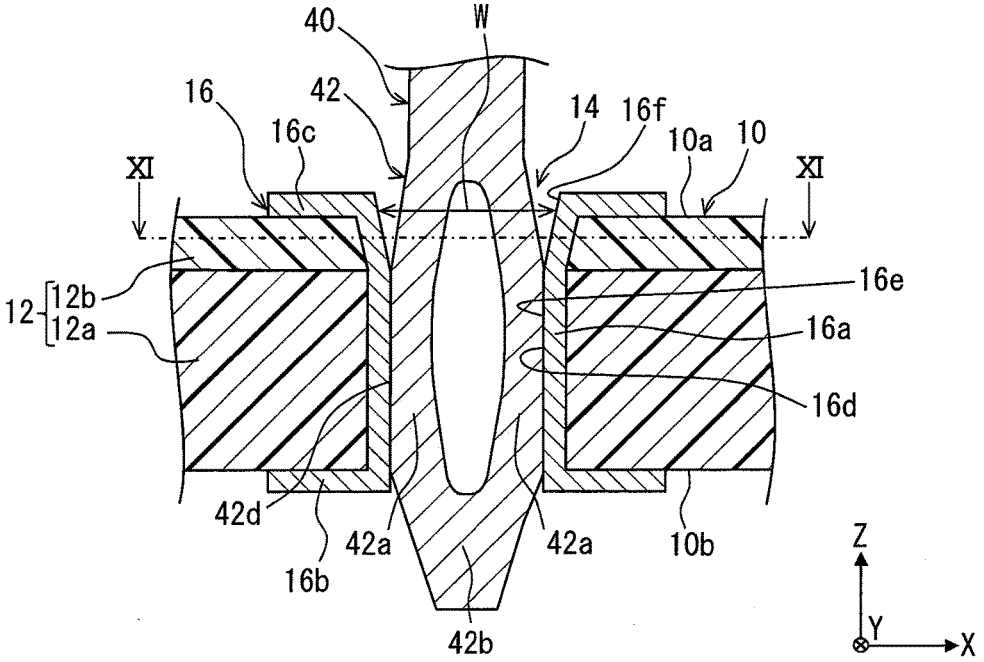
FIG. 10 is a cross-sectional view illustrating the substrate and the press-fit terminal in the electronic device according to a fourth embodiment.
Figure 11:
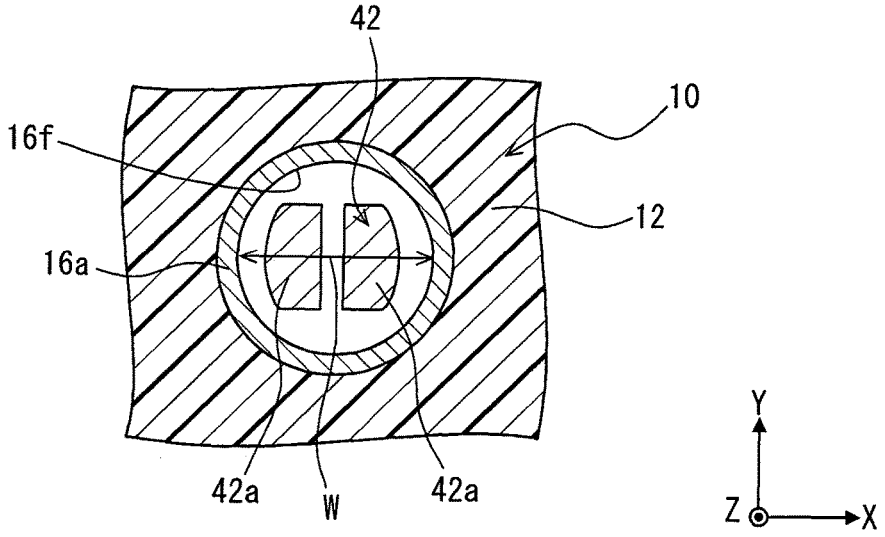
FIG. 11 is a cross-sectional view taken along XI-XI line in FIG. 10.

As shown in FIG. 10, the wall of the through hole 14 has a portion with a tapered shape. That is, the wall portion 16*a* has a tapered portion. More specifically, at least a portion of the wall of the through hole 14 from the contact portion 16*d* to the top surface 10*a* has a width W in a direction perpendicular to the direction Z and the width W gradually widens from the contact portion 16*a* toward the top surface 10*a*. As shown in FIG. 11, the through hole 14 has a substantially circular plane shape, in the present embodiment. Thus, the width W is a diameter of the through hole 14 on the X-Y plane.

The wall portion 16*a* includes a first wall 16*e* and a second wall 16*f* that define the wall of the through hole 14. The first wall 16*e* is connected to the bottom portion 16*b* at one end of the first wall 16*e* in the direction Z and the other end of the first wall 16*e* is connected to the second wall 16*f*. The contact portion 16*d* is a portion of the first wall 16*e*. The first wall 16*e* has a substantially circular plane shape viewed in the direction Z and has a curved surface extending along the direction Z. The diameter of the first wall 16*e* is substantially constant in the direction Z. In other words, the width W of the first wall 16*e* is substantially constant in the direction Z.

The second wall 16*f* is connected to the first wall 16*e* at one end of the second wall 16*f* in the direction Z, and the other end of the second wall 16*f* is connected to the top portion 16*c*. In other words, the second wall 16*f* is positioned closer to the top surface 10*a* than the first wall 16*e* is to. The second wall 16*f* is angled relative to the direction Z. The second wall 16*f* has a substantially circular plate shape when viewed in the direction Z. The diameter of the second wall 16*f* on the X-Y plane varies according to positions along the direction Z. More specifically, the diameter of the second wall 16*f* on the X-Y plane increases from the connection portion with the first wall 16*e* toward the connection portion with the top portion 16*c* in the direction Z. In other words, the width W of the second wall 16*f* expands from the connection portion with the first wall 16*e* toward the connection portion with the top portion 16*c* in the direction Z.

In the present embodiment, the second wall 16*f* is overlapped with the flexible layer 12*b* in the direction Z. On the contrary, the second wall 16*f* is not overlapped with the core layer 12*a* in the direction Z. Alternatively, the second wall 16*f* may be overlapped with the core layer 12*a* in the direction Z.

In the present embodiment, deformation of the press-fit terminal 40 is small when the press-fit terminal 40 is at a position where the press-fit terminal 40 is in contact with the second wall 16*f* in the press-fitting process. Accordingly, in the press-fitting process, great deformation of the press-fit terminal 40 can be suppressed when the press-fit terminal 40 is at a position between the position A and the position B during the press-fitting process. In other words, great deformation of the press-fit terminal 40 at a particular position can be suppressed during the press-fitting process. That is, in the press-fitting process, the press-fit terminal 40 can be deformed in a stepwise manner. Thus, an increase in load applied to the substrate 10 can be suppressed as compared with a configuration where the entire of the wall of the through hole 14 extends along the direction Z.

While the present disclosure has been described with reference to preferred embodiments thereof, it is to be understood that the disclosure is not limited to the preferred embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

In the present embodiments, the electronic device 100 includes the substrate 10, the electronic component 20, the case 30, the press-fit terminal 40, and the housing 50. However, other configuration can be used as long as the electronic device 40 includes at least the substrate 10 and the press-fit terminal 40.

In the present embodiments, the electrode 16 is formed of nickel. Alternatively, material other than nickel may be used for the electrode 16.

In the present embodiments, the contact surface 42*d* of each of the arms 42*a* extends along the direction Z and is a curved surface along the wall of the through hole 14. Alternatively, other configurations may be used as long as at least a portion of the elastic member 42 is in contact with the wall portion 16*a* and a reaction force by elastic deformation of the press-fit terminal 40 is applied to the wall of the press-fit terminal 40. The arm 42*a* may have a substantially rectangular plane shape.

The contact portion 16*d* may be formed in the wall portion 16*a* from the one end to the other end in the direction Z. In other words, the contact surface 42*d* of the arm 42*a* may be overlapped with the entire of the wall portion 16*a* in the direction Z.

What is claimed is:

1. An electronic device comprising:

a substrate that includes a first surface, a second surface opposite to the first surface in a thickness direction of the substrate, a through hole, and an electrode formed in the first surface, the second surface, and a wall of the through hole; and a press-fit terminal that is fit into the through hole from the first surface while being elastically deformed, the press-fit terminal being connected to the electrode by a reaction force due to the elastic deformation of the press-fit terminal, wherein the substrate includes a core layer that is overlapped, in the thickness direction, with a contact portion of the electrode with the press-fit terminal, and a flexible layer that is at a position closer to the first surface than the core layer is to, the flexible layer having a lower elastic modulus than the core layer, and the core layer and the flexible layer are formed separately from each other.

2. The electronic device according to claim 1, wherein the substrate further includes an intermediate conductor that has rigidity greater than the core layer and the flexible layer and that partially exists between the core layer and the flexible layer, and the contact portion is overlapped, in the thickness direction, with the core layer and the intermediate conductor.

3. The electronic device according to claim 2, wherein the intermediate conductor is connected to the electrode.

4. The electronic device according to claim 2, wherein the intermediate conductor does not provide electric connection.

5. The electronic device according to claim 2, wherein the intermediate conductor has an annular shape around the through hole when viewed in the thickness direction.

6. The electronic device according to claim 1, wherein the substrate further includes a center layer that is arranged between the core layer and the flexible layer and that has an elastic modulus with a value falling within the core layer and the flexible layer.

7. The electronic device according to claim 1, wherein the electrode includes nickel.

8. The electronic device according to claim 1, wherein the wall of the trough hole includes a tapered portion entirely or partially extending between the contact portion and the first surface, the tapered portion having a width along a direction perpendicular to the thickness direction that gradually widens from the contact portion toward the first surface.

* * * * *